US012196539B2

(12) United States Patent
Battaglia

(10) Patent No.: US 12,196,539 B2
(45) Date of Patent: Jan. 14, 2025

(54) POLYMERIC CARTRIDGE ASSEMBLY

(71) Applicant: Vincent Battaglia, Easton, CT (US)

(72) Inventor: Vincent Battaglia, Easton, CT (US)

( * ) Notice: Subject to any disclaimer, the term of this patent is extended or adjusted under 35 U.S.C. 154(b) by 0 days.

(21) Appl. No.: 18/359,258

(22) Filed: Jul. 26, 2023

(65) Prior Publication Data

US 2024/0035789 A1 Feb. 1, 2024

Related U.S. Application Data

(60) Provisional application No. 63/392,982, filed on Jul. 28, 2022.

(51) Int. Cl.
*F42B 5/307* (2006.01)

(52) U.S. Cl.
CPC ..... *F42B 5/307* (2013.01)

(58) Field of Classification Search
CPC ..... F42B 5/30; F42B 5/307; F42B 5/313
USPC ..... 102/464–467
See application file for complete search history.

(56) References Cited

U.S. PATENT DOCUMENTS

| | | | | |
|---|---|---|---|---|
| 8,561,543 | B2 | 10/2013 | Burrow | |
| 11,479,653 | B2 | 10/2022 | Lynch-Branzoi et al. | |
| 2020/0011646 | A1* | 1/2020 | Burrow | F42C 19/083 |
| 2023/0358515 | A1* | 11/2023 | Cogger | F42B 33/001 |

FOREIGN PATENT DOCUMENTS

| | | | | |
|---|---|---|---|---|
| GB | 2606365 A | * | 11/2022 | F42B 5/26 |

* cited by examiner

*Primary Examiner* — Reginald S Tillman, Jr.
(74) *Attorney, Agent, or Firm* — DeLio Peterson & Curcio LLC; Robert Curcio

(57) ABSTRACT

A polymeric cartridge subassembly for use in medium caliber weaponry, comprising a metallic base having a rearward surface, an open forward surface, and a coupling element therebetween. A polymeric casing is mated with the base coupling element via a coupling end, and includes a forward end opening, an opposite end, and a middle body portion therebetween. The forward end opening is adapted to receive a projectile, and the coupling end has an outer diameter less than that of the middle body portion to facilitate mating with the base coupling element. The polymeric casing is formed from a graphene-reinforced polymer matrix composite which is light-weight; producing necessary ballistics for medium caliber ammunition without deformation of the polymeric casing after firing.

21 Claims, 8 Drawing Sheets

POLYMERIC CARTRIDGE ASSEMBLY

BACKGROUND OF THE INVENTION

1. Field of the Invention

The present invention relates in general to the field of ammunition, and more specifically to a polymeric ammunition cartridge casing for use with medium caliber ammunition.

2. Description of the Related Art

Medium Caliber Ammunition (hereinafter, "MCA") includes 20 mm, 25 mm, 30 mm, and 40 mm Armor-Piercing (AP), High-Explosive (HE), smoke, illumination, training, and antipersonnel cartridges, and is designed to defeat light armor, material, and personnel targets. Generally, medium caliber weapons utilizing MCA are installed on military aircraft, helicopters, main battle tanks, infantry fighting vehicles, armored personnel carriers, and the like. In order to achieve necessary projectile velocities, prior art MCA casings are constructed of metals and metal alloys, such as aluminum metal, copper, aluminum alloy, and the like.

Current 20 mm and 30 mm MCA case manufacturing entails manufacturing processes that are equipment intensive as well as expensive. The manufacturing processes include forging and draw form stamping for the creation of MCA within steel or aluminum cases. Additional machining or trimming operations are also necessitated to complete the ammunition case. As a result, bottlenecks and/or shortages can arise during the operation of traditional manufacturing processes. These shortages are often amplified due to limitations on manufacturing capacity or the availability of raw material.

FIG. 1 depicts a cross-sectional view of a prior art MCA case. The geometry of the internal base of current MCA casings (such as 30×113 mm MCA casings) often stems from constraints in the manufacturing process, including a needed forging profile to achieve appropriate cartridge density or transfer material for an external feature. In order to produce velocities required for proper ballistic operation of the MCA, there is a heavy dependency on the quantity of the propellant charge. This, as a result, creates further issues with manufacturing bottlenecking and/or shortages within the MCA supply chain.

In addition, current MCA casings constructed of lighter weight metals, such as aluminum, are often mass-intensive when considering a complete payload. By way of example, a complete 30×113 mm medium caliber round will have a mass on the order of 340 g (0.75 lbs), resulting in strain on the equipment housing the complete payload which decreases battle efficiency and increases military resource consumption.

In U.S. Pat. No. 11,479,653 issued to Rutgers, The State University of New Jersey on Oct. 25, 2022, titled "USE OF GRAPHENE-POLYMER COMPOSITES TO IMPROVE BARRIER RESISTANCE OF POLYMERS TO LIQUID AND GAS PERMEANTS," a packaging material is taught that uses a graphene-reinforced polymer matrix composite (G-PMC). The G-PMC is produced using a plastic material comprising graphene nano-flakes which produces improved barrier property, mechanical properties, and durability. Like other polymers, G-PMCs possess a number of desirable physical properties, are lightweight, and inexpensive.

Therefore, it would be desirous to achieve an MCA casing of reduced mass, while also increasing the performance, velocity, and burn rate efficiency of produced from MCA casings. It would further be desirable to employ a parallel manufacturing process that is scalable for the entire inventory of MCA cases of all sizes and neck types to facilitate integration into existing manufacturing facilities.

SUMMARY OF THE INVENTION

Bearing in mind the problems and deficiencies of the prior art, it is therefore an object of the present invention to provide MCA casings of decreased mass.

It is another object of the present invention to raise performance, velocity, and burn rate efficiency produced from MCA casings.

A further object of the invention is to provide a parallel manufacturing process that is scalable for the entire inventory of MCA casings of all sizes and neck types to facilitate integration into existing manufacturing facilities.

Still other objects and advantages of the invention will in part be obvious and will in part be apparent from the specification.

The above and other objects, which will be apparent to those skilled in the art, are achieved in the present invention which is directed to a polymeric cartridge subassembly for use in medium caliber weaponry. The subassembly comprises a metallic base having a rearward surface, an open forward surface, and a coupling element therebetween. The rearward surface includes a primer recess for receiving a primer, the primer recess having an opening extending into an interior portion of the subassembly forming a combustion chamber. A polymeric casing is securable to the metallic base and includes a forward end opening, an opposite end, and a middle body portion therebetween. The forward end opening may be adapted to receive a projectile, the opposite end forming a coupling end sized to and being mated with the base coupling element. The polymeric casing may be formed from a graphene-reinforced polymer matrix composite (G-PMC).

The polymeric casing may include a shoulder portion for couplable engagement with the metallic base forward surface such that a ledge member of the metallic base receives the casing opposite end during subassembly.

The graphene-reinforced polymer matrix composite may be formed from a thermoplastic selected from the group consisting of: high density polyethylene, polyethylene terephthalate, polystyrene, polyamide 6-6, polysulfone, polyphenylene sulfide, and polyether-ether-ketone. In some embodiments, the graphene-reinforced polymer matrix composite may comprise 35% graphite in 65% polyether-ether-ketone (PEEK) polymer that has been fully exfoliated. In other embodiments, the graphene-reinforced polymer matrix composite may comprise 20% graphite in 80% polyphenylene sulfide (PPS) that has been fully exfoliated.

The polymeric cartridge subassembly may include a retaining insert received within the combustion chamber of the polymeric casing, the retaining insert ensuring engagement between the polymeric casing and the metallic base. The base may include a plurality of apertures disposed around an arch length of the base and in communication with the combustion chamber of the polymeric casing, and a mechanical fastening member received in each of the plurality of apertures forming a compression assembly between the polymeric casing, the metallic base, and the retaining insert.

The polymeric cartridge subassembly forward end opening may include at least one protrusion on an interior surface and extending radially inwards towards the polymeric casing. The at least one protrusion may comprise an Acme thread pattern and a tear perf at a root of the Acme thread pattern. The polymeric cartridge subassembly may comprise a medium caliber ammunition subassembly for use with medium handheld, crew-served, ground, platform, and aircraft mounted weapons.

In another aspect, the present invention is direct to a method of assembling a polymeric cartridge for use in medium caliber weaponry. The method comprises the steps of securing a coupling end of a polymeric casing to a coupling element of a metallic base such that the coupling element encapsulates an interior combustion chamber of the polymeric casing. A primer may be inserted into a primer recess of the base, and a propellant charge may be inserted within the combustion chamber. The method further comprises seating a projectile onto a forward end opening of the polymeric casing to encapsulate the combustion chamber. The polymeric casing may be formed from a graphene-reinforced polymer matrix composite.

In some embodiments, the projectile may comprise a medium caliber projectile. The method may further comprise inserting a retaining insert within the combustion chamber, and securing a mechanical fastening member within each of a plurality of apertures disposed on an arch length of the base such that the mechanical fastening member is received by the retaining stamping and the base. The method may further include forming a compression assembly between the casing, the base, and the retaining insert. In other embodiments, the forward end opening may include at least one protrusion on an interior surface to ensure a contact point with the projectile and a predetermined cartridge overall length elevation during assembly.

BRIEF DESCRIPTION OF DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
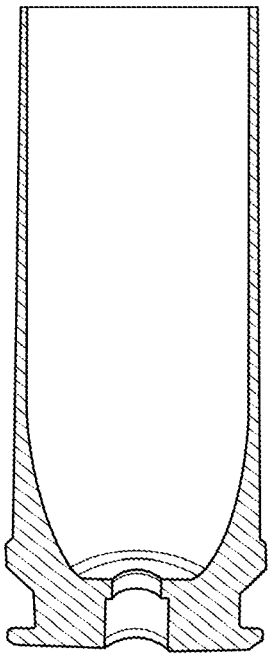
FIG. 1 (PRIOR ART)
FIG. 1 depicts a cross-sectional view of a prior art medium caliber ammunition (MCA) casing.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc., may be used herein to describe various components, these components should not be limited by these terms. These terms are only used to distinguish one component from another. For example, a first element could be termed a second element, and, similarly, a second element could be termed a first element, without departing from the scope of the present invention. As used herein, the singular forms "a", "an", and "the" are intended to include the plural forms as well, unless the context clearly indicates otherwise. Also, as used herein, the term "and/or" includes any and all combinations of one or more of the associated listed items. It will be further understood that the terms "include" and/or "including" when used herein, specify the presence of stated features, steps, operations, elements, and/or components, but do not preclude the presence or addition of one or more other features, steps, operations, elements, components, and/or groups thereof.

Relative terms such as "below," "above," "upper," "lower," "horizontal," "vertical," "top," "bottom," "rear," "front," "side," or the like may be used herein to describe a relationship of one element or component to another element or component as illustrated in the figures. It will be understood that these terms are intended to encompass different orientations of the device in addition to the orientation depicted in the figures.

Additionally, in the subject description, the words "exemplary," "illustrative," or the like are used to mean serving as an example, instance or illustration. Any aspect or design described herein as "exemplary" or "illustrative" is not necessarily intended to be construed as preferred or advantageous over other aspects or design. Rather, use of the words "exemplary" or "illustrative" is merely intended to present concepts in a concrete fashion.

In describing the embodiment of the present invention, reference will be made herein to FIGS. 1-12 of the drawings in which like numerals refer to like features of the invention.

The polymeric ammunition cartridges of the present invention are of a caliber typically carried by military units in combat with medium handheld, crew-served, ground, platform, and aircraft mounted weapons. Such medium caliber munitions include 20 mm, 25 mm, 30 mm, 40 mm, and the like. The present invention should not be limited to the described caliber and is believed to be applicable to other calibers as well. This includes various small caliber munitions, including 5.56 mm, 9 mm, 7.62 mm, and .50 caliber, as well as 10 gauge, 12 gauge, .22 caliber, .30 caliber, .38 caliber, .45 caliber, 0.300 WinMag, and the like. Thus, the present invention may be applicable to the sporting goods industry for use by hunters and target shooters.

The present invention may utilize a graphene-reinforced polymer matrix composite (G-PMC) produced using thermoplastics and low-cost mined graphite. An example of such G-PMCs is disclosed in U.S. Pat. No. 11,479,653 issued to Rutgers, The State University of New Jersey on Oct. 25, 2022, entitled "USE OF GRAPHENE-POLYMER COMPOSITES TO IMPROVE BARRIER RESISTANCE OF POLYMERS TO LIQUID AND GAS PERMEANTS." The process of producing G-PMCs includes exfoliating low-cost mined graphite into graphene nano-flakes (GNF) in-situ with molten polymer, creating the G-PMC which may be injection molded.

Figure 2:
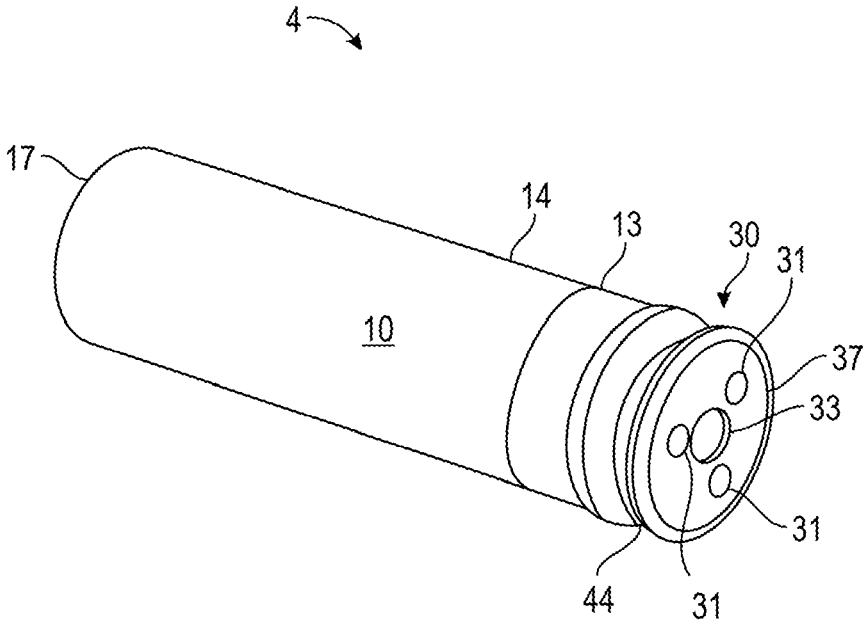
FIG. 2 depicts a perspective view of a polymeric cartridge subassembly according to one embodiment of the present invention.
Figure 3:
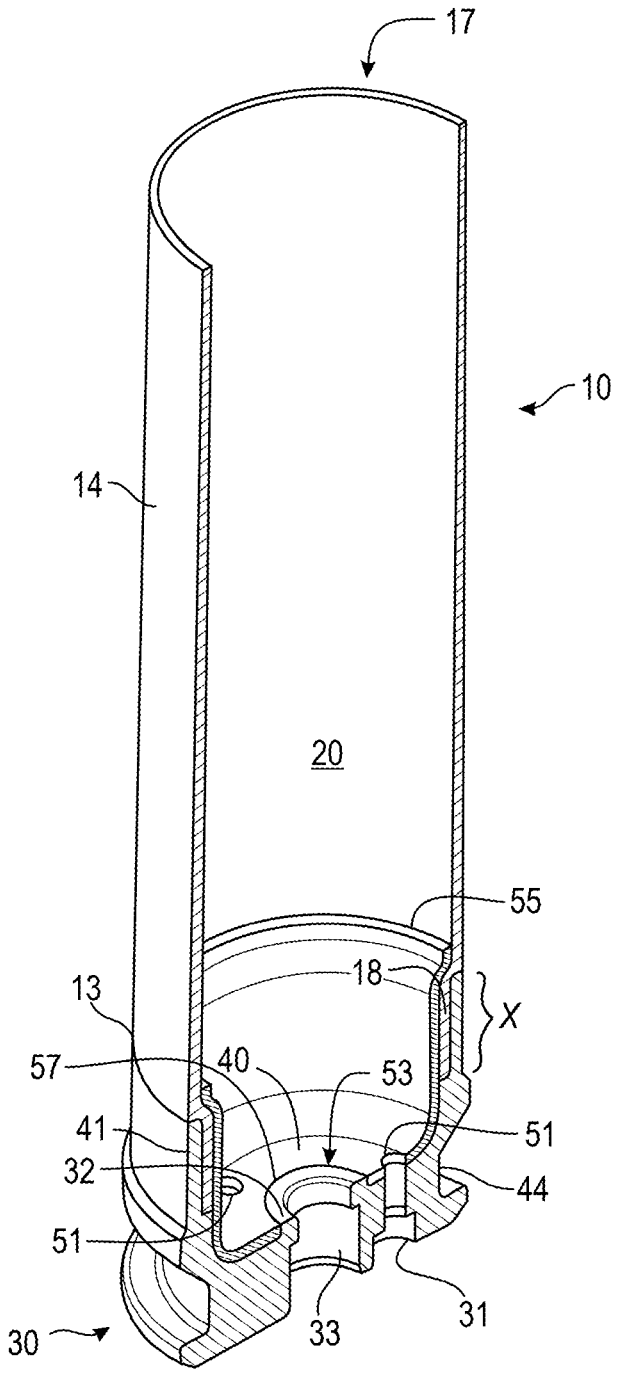
FIG. 3 depict a cross-sectional perspective view of a polymeric cartridge subassembly according to the embodiment of FIG. 2.

FIGS. 2 and 3 depict a perspective and cross-sectional view of a polymeric cartridge subassembly according to one embodiment of the present invention. The cartridge subassembly 4 suitable for use with medium caliber weaponry is shown including a polymeric casing 10 having a combustion chamber 20 and a forward end opening 17. Casing 10 includes has a substantially cylindrical open-ended middle body portion 14 extending from forward end opening 17 rearward to opposite end 15 (shown in FIG. 5). The middle body portion 14 may be formed with coupling end 18 formed on end 15. Coupling end 18 comprises a cylindrically notched joint or element, but may also be configured to be a tapered joint, or as a male or female connecting element in alternate embodiments of the invention.

The middle body portion 14 is connected to a substantially cylindrical coupling element 41 of the substantially cylindrical base 30. Coupling element 41, as shown, may be configured as an annular ring or a cylindrically tapered joint or notched element, however, combinations such as male and female configurations are acceptable for coupling element 41 and coupling end 18 in alternate embodiments of the invention. Coupling end 18 of the middle body portion 14 fits about and engages coupling element 41 by an interference, friction fit. Base 30 may be constructed of any sufficiently rigid light-weight metals or alloys such as aluminum, steel, leaded alloys, and the like. The base 30 includes an extractor groove 44 and a primer recess 33 exposed on the bottom center for ease of insertion of the primer (not shown). The primer recess 33 is sized so as to receive the primer (not shown) in an interference fit assembly. A primer flash hole 39 (see FIG. 4) communicates through the bottom surface 40 of the base 30 into the combustion chamber so that upon detonation of the primer (not shown) the propellant charge within the combustion chamber 20 will be ignited.

Figure 5:
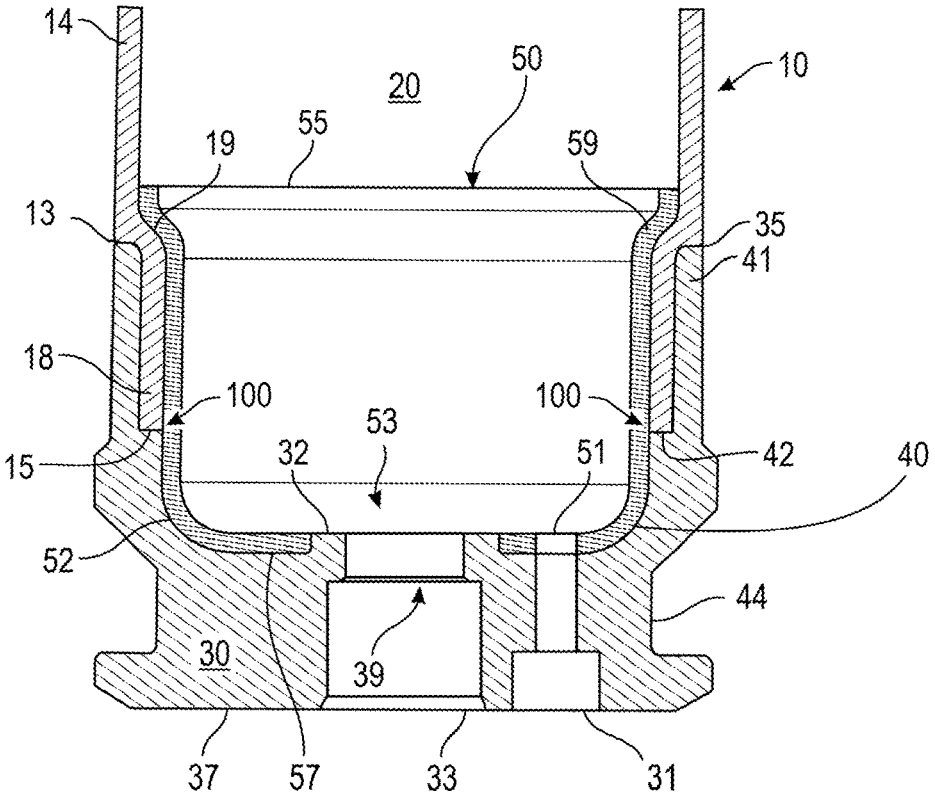
FIG. 5 depicts a cross-sectional view of a portion of a polymeric cartridge subassembly according to the embodiment of FIG. 4.
Figure 6:
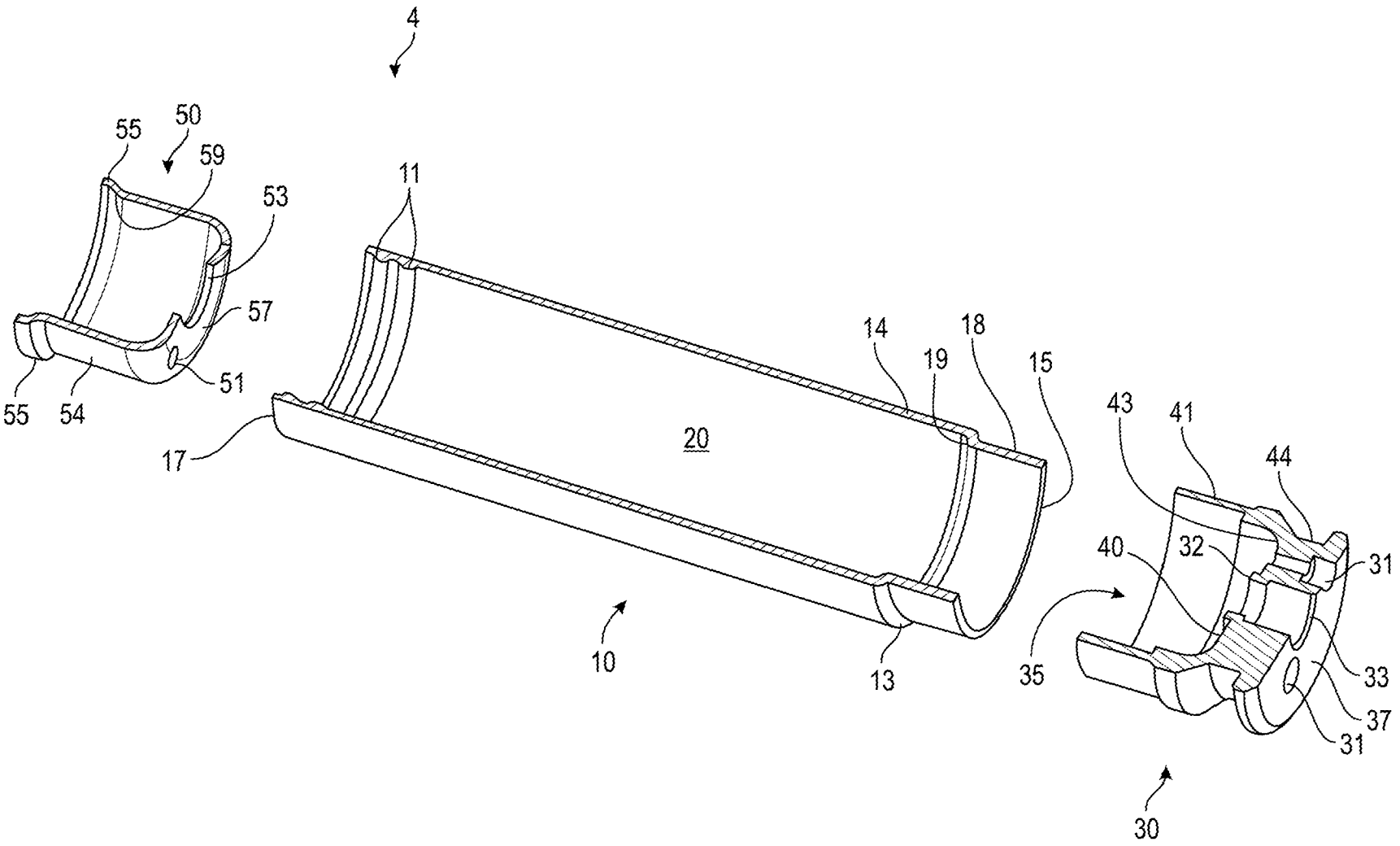
FIG. 6 depicts an exploded cross-sectional perspective view of a polymeric cartridge subassembly according to one embodiment of the present invention.

Referring to FIG. 5, the cartridge base 30 includes a substantially cylindrical coupling element 41 extending to a forward surface 35 that is opposite a rearward surface 37. During assembly, shoulder portion 13 of the casing 10 mates with and engages base forward surface 35 such that the casing opposite end 15 is received by ledge member 42 of base 30. A substantially cylindrical retaining insert 50 fits about and engages coupling element 41 and coupling end 18 by an interference fit, ensuring engagement between casing opposite end 15 and ledge member 42, as well as shoulder portion 13 and forward surface 35. Retaining insert 50 may be constructed of any sufficiently rigid light-weight metals or alloys such as aluminum, steel, leaded alloys, and the like. The retaining insert increases the integrity of the connection between the base 30 and casing 10, particularly in the high-pressure regions of the fully assembled cartridge during interior ballistic operations.

Combustion chamber 20 contains a propellant charge (not shown), which may comprise a nitrocellulose propellant, nitroglycerin propellant, and the like. The interior volume of combustion chamber 20 may be varied to provide the volume necessary for complete filling of the chamber 20 to a volumetric measurement appropriate to ensure proper ballistic performance.

Base 30 comprises a rearward surface 37 and coupling element 41 extending from the base bottom surface 40 to open-ended forward surface 35. The inner diameter of coupling element 41 is sized to fit about and engage the outer diameter of coupling end 18 in an interference engagement. Coupling element 41, as well as coupling end 18 are sized to ensure complementary engagement of casing opposite end 15 with base ledge member 42, and base forward surface 35 with casing shoulder 13. In addition, the outer diameter of coupling element 41 may be sized to fit about and engage the inner diameter of coupling end 18 in an interference engage in alternate embodiments of the invention. The longitudinal and circumferential engagement surface X between coupling element 41 and coupling end 18 may be sized as necessary to withstand the gas pressures resulting from interior ballistics and prevent deformation/damage to the cartridge subassembly 4 which would otherwise inhibit proper exterior or terminal ballistic operations.

Base rearward surface 37 may include one or more apertures 31 for communication with a mechanical fastening member (not shown). Aperture(s) 31 communicate through the bottom surface 40 of the base 30 into the combustion chamber 20. The number of apertures will depend on the specific application and propellant charge necessary but may include 1, 2, 3, 4, 5, or more apertures. One embodiment (depicted in FIG. 2) includes three (3) apertures 31 disposed around an arch length of the base 30 such that each aperture is a predetermined angular distance from the other (e.g., approximately 120 degrees). The primer recess 33 is sized so as to receive the primer (not shown) in an interference fit assembly. A primer flash hole 39 communicates through the bottom surface 40 of the base 30 into the combustion chamber 20, and is surrounded by a raised circumferential wall 32.

Circumferential wall 32 is sized to engage primer port opening 53 of retaining insert in an interference engagement. Retaining insert 50 advantageously provides additional reinforcement to high-pressure regions of the cartridge subassembly 4, increasing hoop and elongation stress tolerances. Retaining insert 50 increases joint strength, preventing deformation and ensuring proper extraction of the chambered cartridge casing after cook-off temperatures.

Retaining insert 50 may be constructed of any sufficiently rigid light-weight metals or alloys such as aluminum, steel, leaded alloys, and the like. Retaining insert 50 comprises a bottom surface 57 having an approximately central primer port opening 53. Primer port opening 53 fits about and engages circumferential wall 32 in an interference engagement. An extension member 54 extends from contoured region 52 towards undulation 59 and rim end 55. Undulation 59 of the retaining insert 50 forms an outward extending projection terminating in rim end 55, creating an outer diameter greater than extension member 54.

Figure 4:
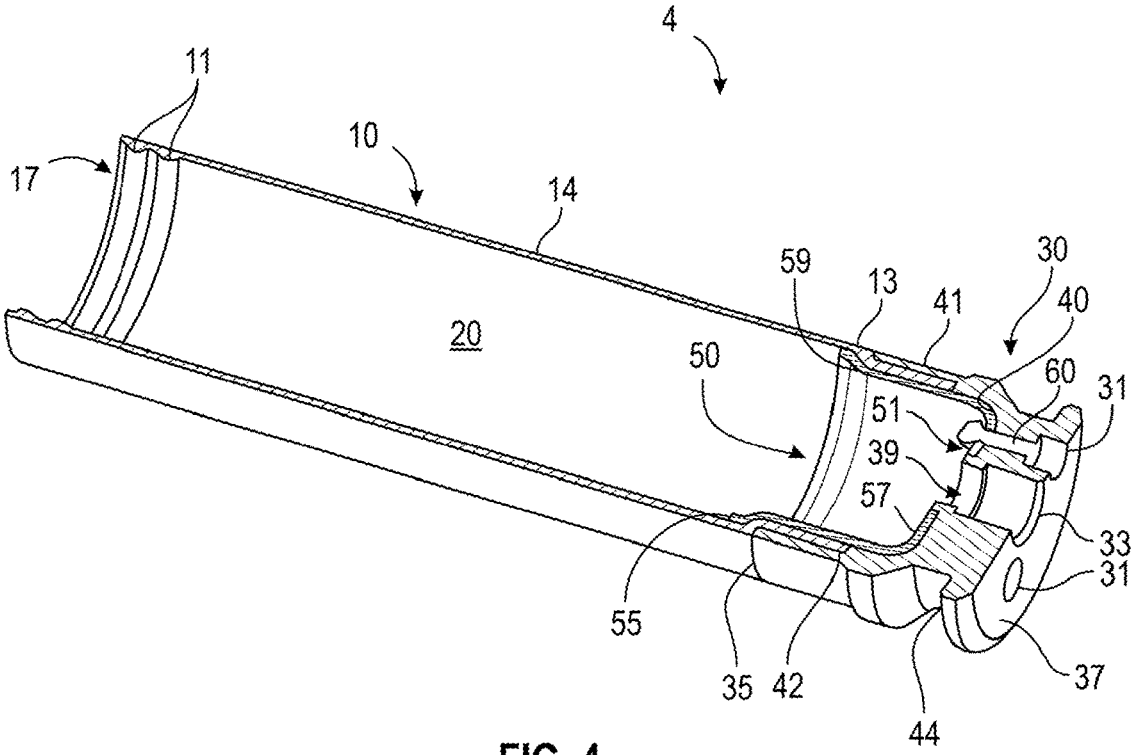
FIG. 4 depicts a cross-sectional perspective view of a polymeric cartridge subassembly displaying protrusions according to the embodiment of FIG. 3.

With additional reference to the cross-sectional perspective view depicted in FIG. 4, insert bottom surface 57 may include one or more openings 51 for communication with base aperture(s) 31 and mechanical fastening member(s) 60. The number of openings will depend on the specific application and propellant charge necessary but may include 1, 2, 3, 4, 5, or more openings. One embodiment includes three (3) openings 51 disposed around an arch length of the insert 50 such that each opening is a predetermined angular distance from the other (e.g., approximately 120 degrees) and in communication with aperture(s) 31 of the base. The mechanical fastening member(s) 60 may comprise rivets, threaded fasteners, and the like. The fastening member(s) 60 may be inserted through aperture(s) 31 and opening(s) 51 forming a compression assembly between the casing base 30, and insert 50. The fastening member(s) and aperture(s) 31 and opening(s) can then be welded or bonded together using solvent, adhesive, spin-welding, vibration-welding, ultrasonic-welding, or laser-welding techniques. In one embodiment a UV curable adhesive, such as Hernon Manufacturing, Inc.'s ULTRABOND® 721, may be utilized.

Fastening member(s) 60 urges insert rim end 55 towards the casing interior portion 19 opposite shoulder 13. Upon compression, the insert undulation 59 engages interior portion 19, sealing the retaining insert 50 to the combustion chamber 20 at an elevation required to ensure proper interior ballistics. Upon compression hoop stress and elongation stress of the subassembly will be increased. In effect, high-pressure regions of the cartridge subassembly 4 are additionally reinforced, increasing joint strength, and preventing deformation and ensuring proper extraction of the chambered cartridge subassembly after cook-off temperatures. The common contact point 100 between base retaining insert 50, and the polymer casing 10 ensures structural integrity of the cartridge subassembly 4 at all stages of ballistic operations, and is particularly effective with medium caliber ammunition (e.g., a cartridge overall length (COAL) greater than 190 mm and/or exterior ballistic velocities of over 800 m/sec).

A projectile (not shown) is held in place within at forward end opening 17, and engages the casing 10 by an interference fit. Mechanical crimping of the forward end opening 17 can also be applied to increase the bullet pull force. The bullet (not shown) may be inserted into place following the completion of the filling of combustion chamber Projectile (not shown) can also be injection molded directly onto the forward end opening 17 prior to welding or bonding together using solvent, adhesive, spin-welding, vibration-welding, ultrasonic-welding or laser-welding techniques.

Figure 7:
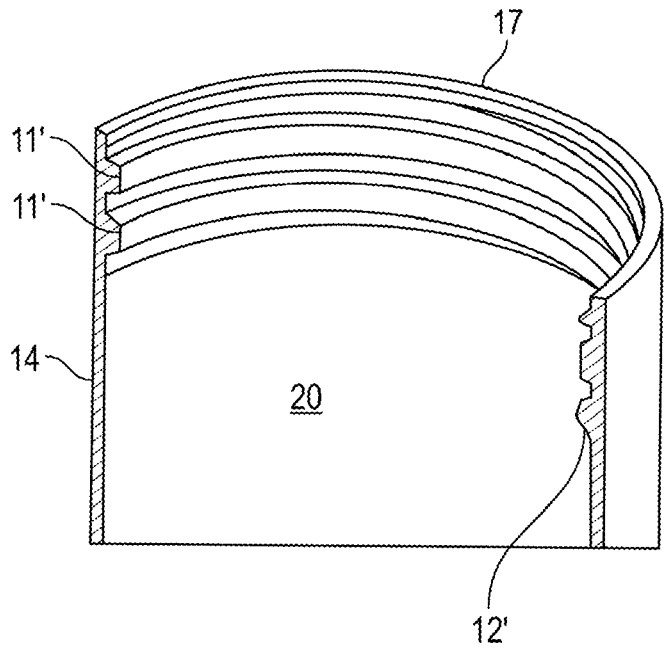
FIG. 7 depicts a cross-sectional view of a portion of a polymeric cartridge subassembly displaying protrusions according to the embodiment of FIG. 6.

FIGS. 4 and 7 depict cross-sectional perspective views of at least a portion of a polymeric cartridge subassembly displaying protrusions according to one embodiment of the present invention. To achieve a high pull force to secure a projectile (not shown) to casing 10, the substantially cylindrical forward end opening 17 or anywhere within the combustion chamber 20 may include one or more protrusions 11 on the casing interior surface. The number of protrusions will depend on the specific bullet size and required pull force but may include 1, 2, 3, 4, 5, or more protrusions. One embodiment (depicted in FIG. 7) includes protrusions forming an Acme thread pattern 11', and includes a tear perf 12' at the root of Acme thread pattern 11' to eject the projectile. The bullet (not shown) may be inserted into place following the completion of the filling of combustion chamber and may be welding or bonding onto the forward end opening 17 using solvent, adhesive, spin-welding, vibration-welding, ultrasonic-welding, or laser-welding techniques. Use of the solvent, adhesive, welding, and the like, in conjunction with protrusions 11 ensures a proper projectile contact point and cartridge overall length (COAL) elevation at the time of assembly. During seating of embodiments utilizing an Acme thread pattern 11', the projectile (not shown) can be rotated on the forward end opening 17 such that the projectile (not shown) will become screwed or self-thread within the opening 17 to the proper COAL elevation, and may include an adhesive developed for the required release force.

Protrusions 11 may have any geometric configuration such as rounded, tapered, concave, convex, and the like, and may include ridging, knurling, and the like, to provide a frictional surface to ensure proper seating of the projectile. The protrusions 11, 11' ensures consistent bullet seating and elevations during manufacture and ensures proper pull force during ballistic operations.

The thickness of retaining insert 50 can be modified as necessary to effect a predetermined hoop stress tolerance within the cartridge subassembly 4 depending on the size of the propellant charge and bullet caliber. Similarly, the size of base 30 and case may be modified as necessary to furnish a predetermined elongation strength to prevent deformation of the subassembly at required chamber pressures during ballistic operations.

Figure 8:
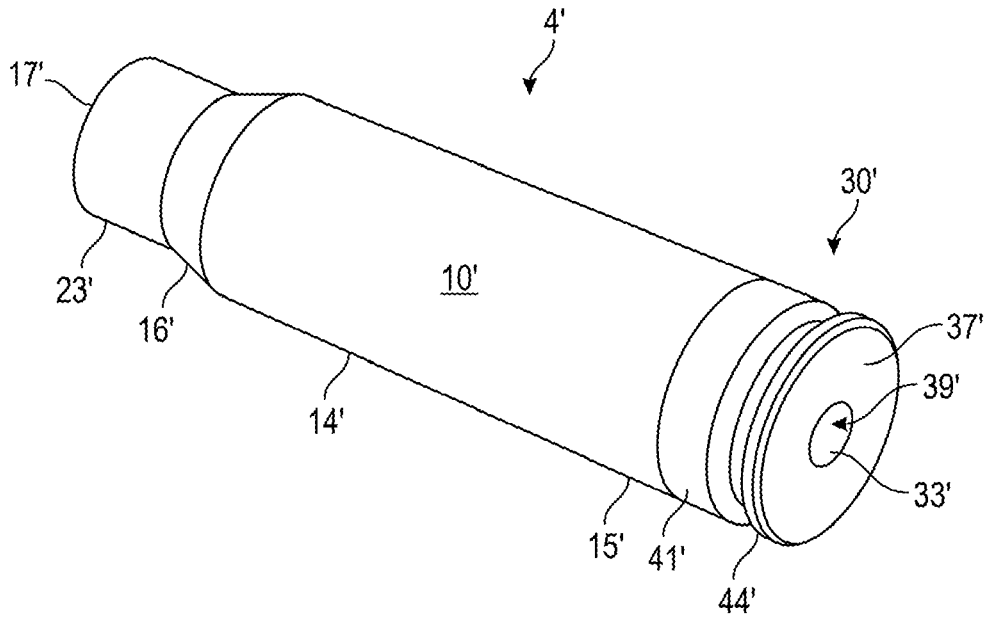
FIG. 8 depicts a perspective view of a polymeric cartridge subassembly according to one embodiment of the present invention.
Figure 9:
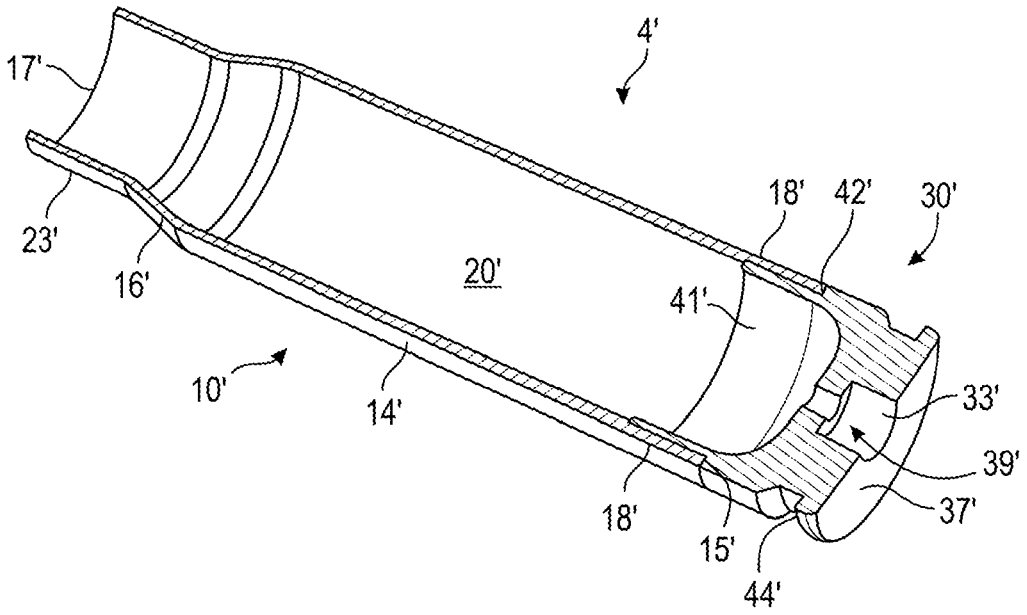
FIG. 9 depicts a cross-sectional perspective view of a polymeric cartridge subassembly according to the embodiment of FIG. 8.
Figure 10:
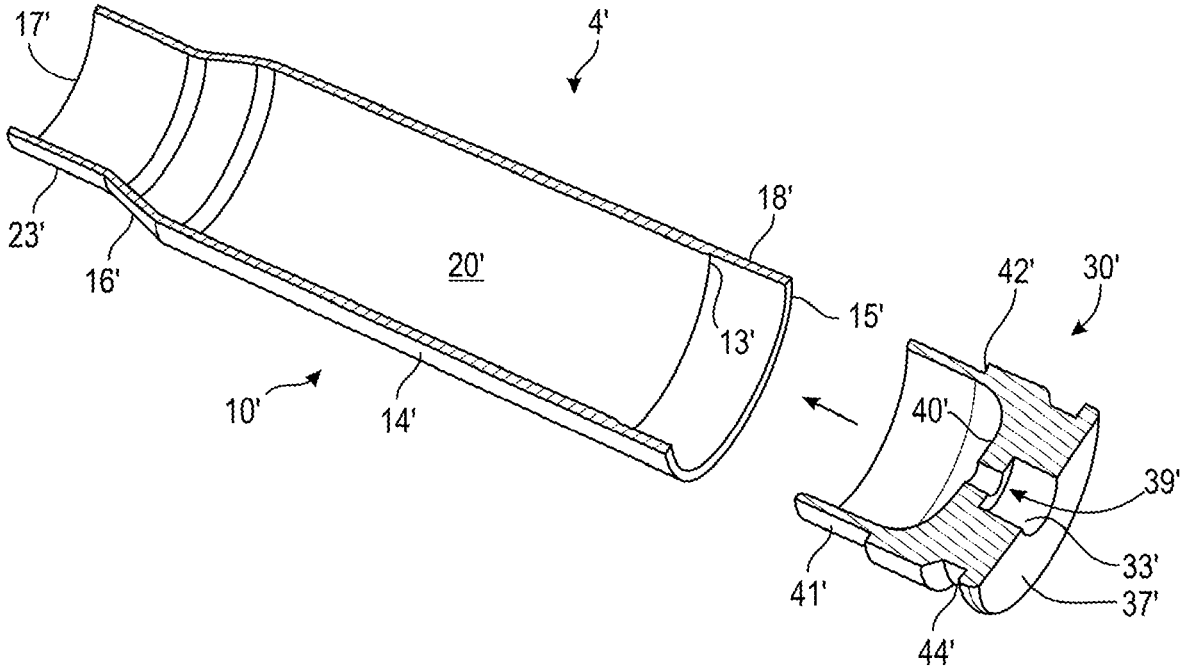
FIG. 10 depicts an exploded cross-sectional perspective view of a polymeric cartridge subassembly according to the embodiment of FIG. 9.

FIGS. 8-10 depict perspective, cross-sectional, and exploded cross-sectional views of a polymeric cartridge subassembly according to one embodiment of the present invention. The cartridge subassembly 4' suitable for use with medium caliber weaponry includes a polymeric casing 10' having a combustion chamber 20' with projectile (not shown) inserted into the forward end opening 17'. Casing 10' includes has a substantially cylindrical open-ended middle body portion 14' extending from forward end opening 17' rearward to opposite end 15'. The forward end of the substantially cylindrical open-ended middle body portion 14' has a shoulder 16' forming a chamber neck 23'. The middle body portion 14' may be formed with a coupling end 18' formed on end 15'. Coupling end 18' comprises a conical tapered joint or notched element, but may also be configured as a male or female connecting element in alternate embodiments of the invention.

The middle body portion 14' is connected to a substantially cylindrical coupling element 41' of the substantially cylindrical base 30'. Coupling element 41', as shown may be configured as a conical tapered joint or notched element, however, combinations such as male and female configurations are acceptable for coupling element 41' and coupling end 18' in alternate embodiments of the invention. Coupling end 18' of the middle body portion 14' fits about and engages coupling element 41' by an interference fit. Base 30' may be constructed of any sufficiently rigid light-weight metals or alloys such as aluminum, steel, leaded alloys, and the like. The case 30' includes an extractor groove 44' and a primer recess 33' formed therein for ease of insertion of the primer (not shown). The primer recess 33' is sized so as to receive the primer (not shown) in an interference fit assembly. A primer flash hole 39' communicates through the bottom surface 40' of the combustion chamber 20' so that upon detonation of the primer (not shown) the propellant charge within the combustion chamber 20' will be ignited.

Casing 10' and base 30' are otherwise similar to casing 10 and base 30 described previously. During assembly, shoulder portion 13' of the casing 10' mates with and engages forward surface 35' such that the opposite end 15' is received by ledge member 42' of base 30', forming an interference engagement between the casing 10' and the base 30'. The casing 10' may also be welded or bonded to base 30' using solvent, adhesive, spin-welding, vibration-welding, ultrasonic-welding, or laser-welding techniques. The coupling end 18' fits about and engages coupling element 41' of the cartridge base 30' by an interference fit. In some embodiments, coupling end 18' may include a taper extending to a larger diameter at the opposite end 15', which interlocks with a reciprocal taper on coupling element 41' to form a physical interlock between cartridge casing 10' and base 30'. Mechanical crimping of the coupling element 41' can also be applied to increase the projectile pull force. Cartridge subassembly 4' may be therefore constructed without need for aperture(s) extending through the base, retaining insert, and/or mechanical fastening member(s) as in the previous embodiment(s).

The inner diameter of coupling element 41' is sized to fit about and engage the outer diameter of coupling end 18' in an interference engagement. Alternately, the outer diameter of coupling element 41' may be sized to fit about and engage the inner diameter of coupling end 18' in an interference engage. Other configurations of engagement, such as male/female connective elements and the like are acceptable for coupling element 41' and coupling end 18' in alternate embodiments of the invention.

Figure 11:
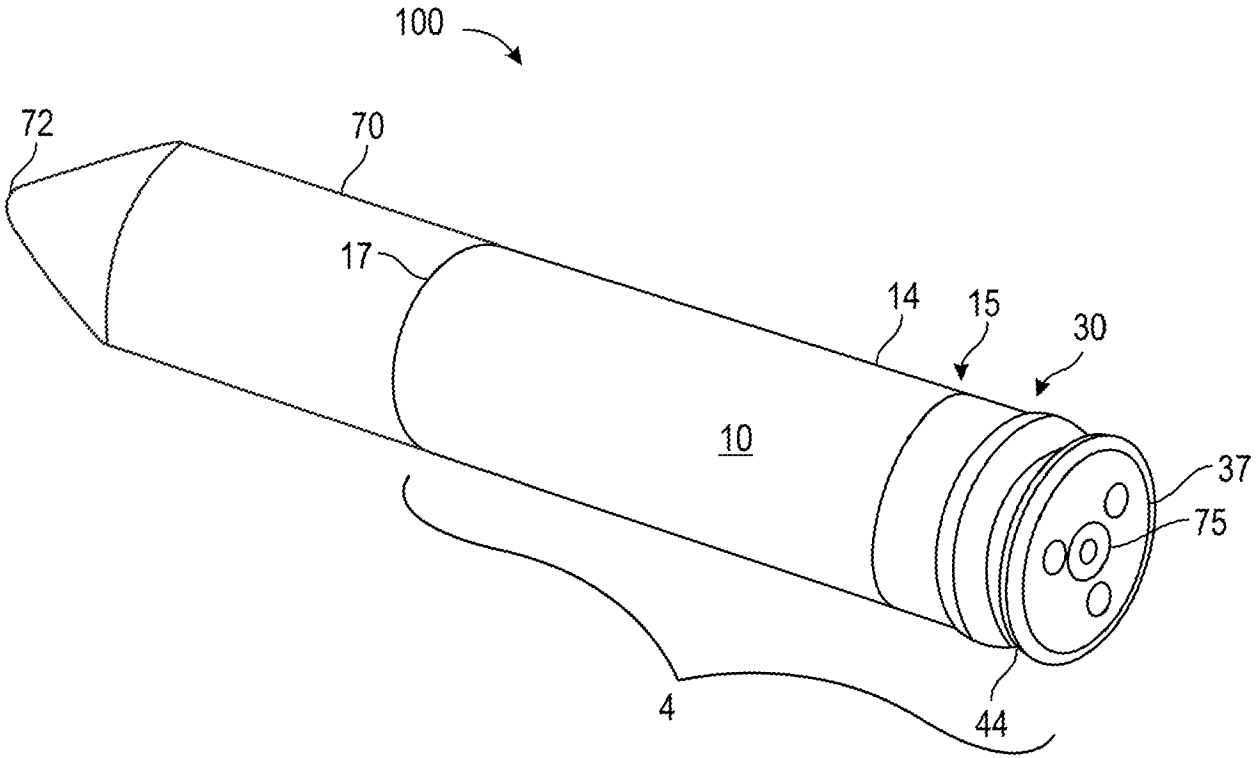
FIG. 11 depicts a perspective view of a polymeric cartridge according to one embodiment of the present invention.
Figure 12:
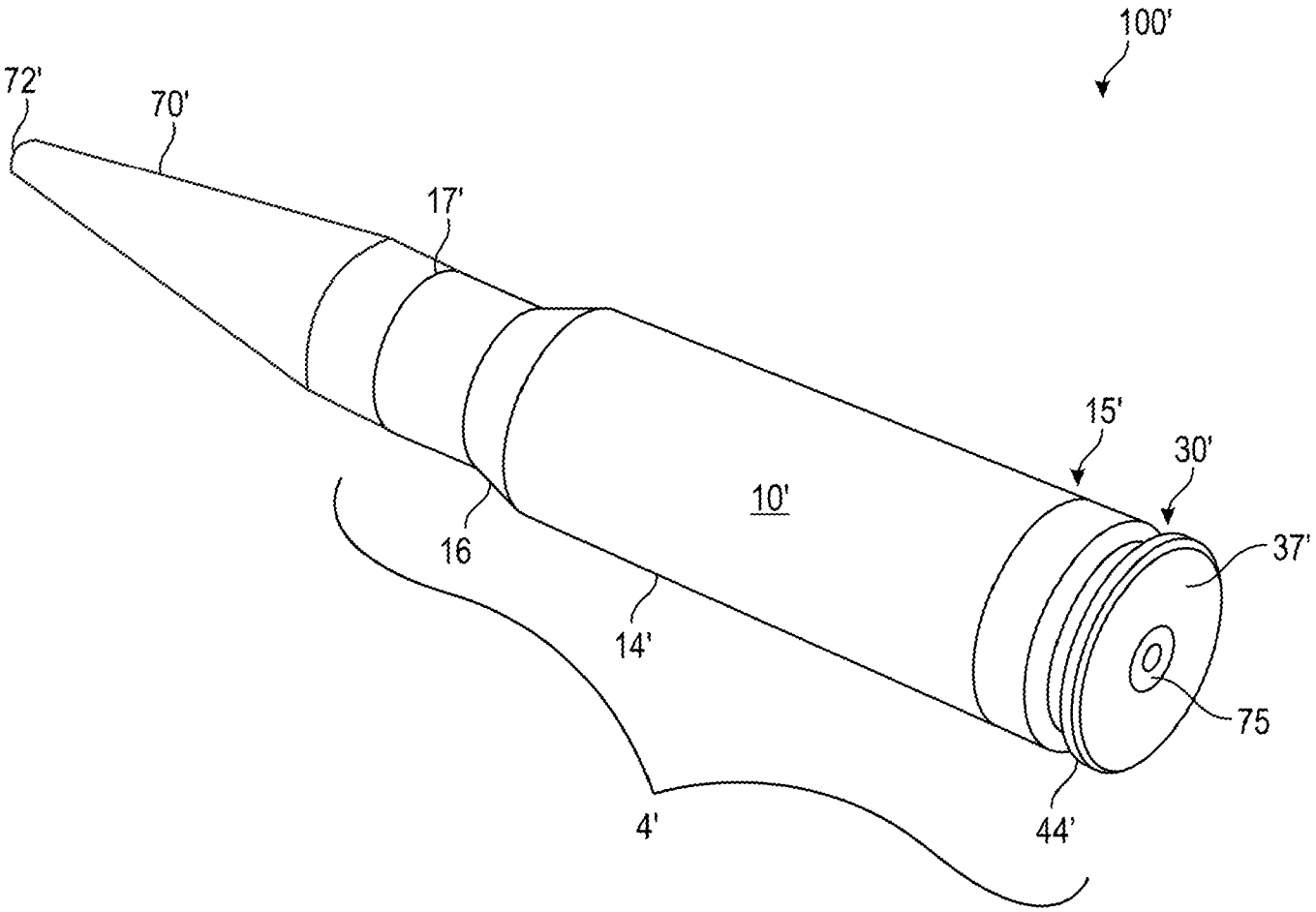
FIG. 12 depicts a perspective view of a polymeric cartridge according to one embodiment of the present invention.

FIGS. 11 and 12 depict perspective views of a polymeric cartridge according to at least one embodiment of the present invention. Cartridge 100, 100' comprises a forward projectile 70, 70' seated onto a cartridge subassembly 4, 4' and encapsulating the combustion chamber (not shown). Projectile 70, 70' is held in place within at forward end opening 17, 17', and engages the casing 10, 10' by an interference fit. Mechanical crimping of the forward end opening 17, 17' can also be applied to increase the bullet pull force. The bullet 70, 70' may be inserted into place following the completion of the filling of combustion chamber (not shown). Projectile 70, 70' can also be injection molded directly onto the forward end opening 17, 17' prior to welding or bonding together using solvent, adhesive, spin-welding, vibration-welding, ultrasonic-welding, or laser-welding techniques. The bullet nose 72, 72' comprises a cone-like or V-shaped construction, but may alternately form a tangent ogive, secant ogive, hybrid ogive, and the like.

To achieve a high pull force to secure projectile 70, 70' to casing 10, 10', the substantially cylindrical forward end opening 17, 17' or anywhere within the combustion chamber may include one or more protrusions (not shown) on the casing interior surface. The bullet 70,70' may be inserted into place following the completion of the filling of combustion chamber (not shown), and may be welding or bonding onto the forward end opening 17, 17' using solvent, adhesive, spin-welding, vibration-welding, ultrasonic-welding, or laser-welding techniques. Use of the solvent, adhesive, welding, and the like, in conjunction with protrusions (not shown) ensures a proper projectile contact point and COAL elevation at the time of assembly, ensuring consistent bullet seating and elevations during manufacture and ensures proper pull force during ballistic operations.

The cartridge subassembly 4, 4' may be suitable for use with medium caliber weaponry and includes a polymeric casing 10, 10' having an interior combustion chamber (not shown) and a forward end opening 17, 17'. Casing 10, 10' includes a substantially cylindrical open-ended middle body portion 14, 14' extending from forward end opening 17, 17' rearward to opposite end 15, 15'. The middle body portion 14, 14' may be formed with coupling end (not shown) formed on end 15, 15' for engagement with coupling element 41, 41' of the substantially cylindrical base 30, 30'. Casing coupling element 41, 41' encapsulates the coupling end and interior combustion chamber of the polymeric casing 10, 10', and may be further secured through mechanical crimping of the coupling element 41', as well as through solvent, adhesive, spin-welding, vibration-welding, ultrasonic-welding or laser-welding techniques.

Base 30, 30' may be constructed of any sufficiently rigid light-weight metals or alloys such as aluminum, steel, leaded alloys, and the like. The base 30, 30' includes an extractor groove 44, 44' and a primer recess (not shown) formed therein for ease of insertion of the primer 75, which is received within the primer recess in an interference engagement. A primer flash hole (not shown) communicates through the base 30, 30' to interior bottom surface (not shown) into communication with the combustion chamber so that upon detonation of the primer 75 the propellant charge within the combustion chamber will be ignited.

The polymeric cartridge of the present invention may be achieved through a cartridge casing 10, 10' constructed of a material comprising a graphene-reinforced polymer matrix composite (G-PMC). Polymeric casings 10, 10' comprising materials consisting of G-PMC dramatically increase the structural integrity of the cartridge subassembly 4, 4' during ballistic operations such that deformation of the casing is eliminated, ensuring proper extraction of the chambered cartridge casing after ballistic operation. This is particularly impactful when utilized with high-powered military rounds, such as medium caliber munitions. For example, exemplary ballistic data for 25 mm caliber ammunition (i.e., MCA) includes muzzle velocities of about 1,100 m/sec and chamber pressures of about 400 MPa. By contrast, 7 mm caliber ammunition (i.e., small caliber ammunition) include muzzle velocities of 970 m/sec and chamber pressures of about 65 MPa.

The polymeric materials for the cartridge casing 10, 10' may be manufactured with G-PMCs comprising thermoplastics and low-cost mined graphite. The process includes exfoliating the low-cost mined graphite into graphene nanoflakes (GNF) in-situ with molten polymer, creating the G-PMC which may be injection molded. Examples of suitable thermoplastics include high density polyethylene (HDPE), polyethylene terephthalate (PET), polystyrene (PS), polyamide 6-6 (PA66), polysulfone (PSU), polyphenylene sulfide (PPS), and polyether-ether-ketone (PEEK) polymers.

In one embodiment, the G-PMC may comprise 35% graphite in 65% PEEK that has been fully exfoliated. In other embodiments, the G-PMC may comprise 20% graphite in 80% PPS that has been fully exfoliated.

A polymeric cartridge subassembly without loaded projectile and propellant charge according to one embodiment of the present invention was manufactured for use with medium caliber munitions. Advantageously, the polymeric cartridge subassembly produced ballistic data comparable to the prior art 30 mm aluminum cartridge casings (such as those depicted in the exemplary FIG. 1) while having a decrease in mass. Overall, the polymeric cartridge subassembly according to one embodiment of the present invention displayed a mass of 0.088 lbs (0.004 kg) resulting in a 27% mass reduction when compared to the mass of prior art 30 mm aluminum cartridge casings of (0.055 kg).

In addition, the tensile modulus (i.e., the ratio of and object's tensile stress to strain when undergoing elastic deformation) of the polymeric cartridge according to the present invention utilizing a G-PMC is significantly improved when compared to polymeric cartridges utilizing thermoplastics without GNF. By way of example, polymeric cartridges constructed of 100% PEEK polymer has a tensile modulus of less than 5 GPa, while the polymeric cartridge utilizing a G-PMC comprising 65% PEEK with 35% fully exfoliated graphite has a tensile modulus of four (4) times pure PEEK, approximately 20 GPa. The polymeric cartridges comprising G-PMC according to the embodiments of the present invention can readily withstand the chamber pressures required for medium caliber munitions without rupture or deformation during ballistic operations.

Thus, the polymeric cartridge of the present invention can reduce the loaded live round weight of MCA by 8%-10%, resulting in increased logistical payloads. The internal volume of the polymeric cartridge subassembly of the present invention may be sized to employ a propellant charge load which can produce ballistic data consistent with current prior art medium caliber ammunition cartridges without causing destruction and/or deformation of the polymeric casing. The polymeric cartridge of the present invention meets or exceeds all existing specifications for current medium caliber ammunition by utilizing the G-PMC polymeric casing in combination with a metallic base constructed of light-weight metals and/or metal alloys.

Spent polymeric casings utilizing G-PMC may be recycled, further increasing the ease of manufacture to meet supply demands for the polymeric cartridges of the present invention. The manufacturing and assembly processes of the present invention in volume will therefore be more cost-effective and easier to manufacture than current processes of manufacture for MCA, while utilizing less metal and decreasing the overall cartridge mass.

A method of assembling a polymeric cartridge according to one embodiment of the present invention is described as follows. The cartridge subassembly 4, 4' may comprise a metallic base 30, 30' coupled to a polymeric casing 10, 10' formed from the graphene-reinforced polymer matrix composite (G-MPC) described above. The method may comprise securing the coupling end 18, 18' of the polymeric casing 10, 10' to a coupling element 41, 41' of base 30, 30', encapsulating an interior combustion chamber 20, 20' of the polymeric casing 10, 10'. A primer may be subsequently inserted into the base primer recess 33, 33', and the combustion chamber 20, 20' may be filled with a propellant charge. The method may further comprise seating a projectile 70, 70' onto the polymeric casing forward end opening 17, 17' to encapsulate and seal combustion chamber 20, 20' to ensure proper ballistic operations of the cartridge 100, 100'.

Thus, the present invention provides one or more of the following advantages: a light-weight polymeric MCA cartridge which can be manufactured at a reduced cost; reduced cartridge weight for MCA while preserving casing integrity; and increased performance, velocity and burn rate efficiency of existing MCA.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A polymeric cartridge subassembly for use in medium caliber weaponry, comprising:

a metallic base having a rearward surface, an open forward surface, and a coupling element therebetween, the rearward surface including a primer recess for receiving a primer, the primer recess having an opening extending into an interior portion of the subassembly forming a combustion chamber;

a polymeric casing having a forward end opening, an opposite end, and a middle body portion therebetween, the forward end opening adapted to receive a projectile, the opposite end forming a coupling end sized to and being mated with the base coupling element, the polymeric casing formed from a graphene-reinforced polymer matrix composite; and a retaining insert received within a combustion chamber of the polymeric casing, the retaining insert ensuring engagement between the polymeric casing and the metallic base;

wherein the base includes a plurality of apertures disposed around an arch length of the base and in communication with the combustion chamber of the polymeric casing, and a mechanical fastening member received in each of the plurality of apertures forming a compression assembly between the polymeric casing, the metallic base, and the retaining insert.

2. The polymeric cartridge subassembly of claim 1, wherein the polymeric casing includes a shoulder portion for couplable engagement with the metallic base forward surface such that a ledge member of the metallic base receives the casing opposite end during subassembly.

3. A polymeric cartridge subassembly for use in medium caliber weaponry, comprising:

a metallic base having a rearward surface, an open forward surface, and a coupling element therebetween, the rearward surface including a primer recess for receiving a primer, the primer recess having an opening extending into an interior portion of the subassembly forming a combustion chamber;

a polymeric casing having a forward end opening, an opposite end, and a middle body portion therebetween, the forward end opening adapted to receive a projectile, the opposite end forming a coupling end sized to and being mated with the base coupling element, the polymeric casing formed from a graphene-reinforced polymer matrix composite;

wherein the graphene-reinforced polymer matrix composite comprises 35% graphite in 65% polyether-ether-ketone (PEEK) polymer that has been fully exfoliated.

4. A polymeric cartridge subassembly for use in medium caliber weaponry, comprising:

a metallic base having a rearward surface, an open forward surface, and a coupling element therebetween, the rearward surface including a primer recess for receiving a primer, the primer recess having an opening extending into an interior portion of the subassembly forming a combustion chamber;

a polymeric casing having a forward end opening, an opposite end, and a middle body portion therebetween, the forward end opening adapted to receive a projectile, the opposite end forming a coupling end sized to and being mated with the base coupling element, the polymeric casing formed from a graphene-reinforced polymer matrix composite;

wherein the graphene-reinforced polymer matrix composite comprises 20% graphite in 80% polyphenylene sulfide (PPS) that has been fully exfoliated.

5. The polymeric cartridge subassembly of claim 1, wherein the graphene-reinforced polymer matrix composite is formed from a thermoplastic selected from the group consisting of: high density polyethylene, polyethylene terephthalate, polystyrene, polyamide 6-6, polysulfone, polyphenylene sulfide, and polyether-ether-ketone.

6. The polymeric cartridge subassembly of claim 3 including a retaining insert received within a combustion chamber of the polymeric casing, the retaining insert ensuring engagement between the polymeric casing and the metallic base.

7. The polymeric cartridge subassembly of claim 6, wherein the base includes a plurality of apertures disposed around an arch length of the base and in communication with the combustion chamber of the polymeric casing, and a mechanical fastening member received in each of the plurality of apertures forming a compression assembly between the polymeric casing, the metallic base, and the retaining insert.

8. The polymeric cartridge subassembly of claim 1 wherein the forward end opening includes at least one protrusion on an interior surface and extending radially inwards towards the polymeric casing.

9. The polymeric cartridge subassembly of claim 8, wherein the at least one protrusion comprises an Acme thread pattern and a tear perf at a root of the Acme thread pattern.

10. The polymeric cartridge subassembly of claim 1, wherein the subassembly comprises a medium caliber ammunition subassembly for use with medium handheld, crew-served, ground, platform, and aircraft mounted weapons.

11. A polymeric cartridge subassembly for use in medium caliber weaponry, comprising:

a metallic base having a rearward surface, an open forward surface, and a coupling element therebetween, the rearward surface including a primer recess for receiving a primer, the primer recess having an opening extending into an interior portion of the base;

a polymeric casing having a forward end opening, an opposite end, and a middle body portion therebetween, the forward end opening adapted to receive a projectile, the coupling end sized to and being mated with the base coupling element; and a retaining insert received within a combustion chamber of the polymeric casing, the retaining insert ensuring engagement between the polymeric casing and the metallic base;

wherein the base includes a plurality of apertures disposed around an arch length of the base and in communication with the combustion chamber of the polymeric casing, and a mechanical fastening member received in each of the plurality of apertures forming a compression assembly between the polymeric casing, the metallic base, and the retaining insert.

12. The polymeric cartridge subassembly of claim 11, wherein the polymeric casing includes a shoulder portion for couplable engagement with the metallic base forward surface such that a ledge member of the metallic base receives the casing opposite end during subassembly.

13. The polymeric cartridge subassembly of claim 11, wherein the polymeric casing is formed from a graphene-reinforced polymer matrix composite.

14. The polymeric cartridge subassembly of claim 13, wherein the graphene-reinforced polymer matrix composite comprises 35% graphite in 65% polyether-ether-ketone (PEEK) polymer that has been fully exfoliated.

15. The polymeric cartridge subassembly of claim 13, wherein the graphene-reinforced polymer matrix composite comprises 20% graphite in 80% polyphenylene sulfide (PPS) that has been fully exfoliated.

16. The polymeric cartridge subassembly of claim 13, wherein the graphene-reinforced polymer matrix composite is formed from a thermoplastic selected from the group consisting of: high density polyethylene, polyethylene terephthalate, polystyrene, polyamide 6-6, polysulfone, polyphenylene sulfide, and polyether-ether-ketone.

17. The polymeric cartridge subassembly of claim 11 wherein the forward end opening includes at least one protrusion on an interior surface.

18. The polymeric cartridge subassembly of claim 17, wherein the at least one protrusion comprises an Acme thread pattern and a tear perf at a root of the Acme thread pattern.

19. A method of assembling a polymeric cartridge for use in medium caliber weaponry, the method comprising the steps of:

securing a coupling end of a polymeric casing to a coupling element of a metallic base such that the coupling element encapsulates an interior combustion chamber of the polymeric casing;

inserting a primer into a primer recess of the base;

inserting a propellant charge within the combustion chamber;

seating a projectile onto a forward end opening of the polymeric casing to encapsulate the combustion chamber, wherein the polymeric casing is formed from a graphene-reinforced polymer matrix composite;

inserting a retaining insert within the combustion chamber;

securing a mechanical fastening member within each of a plurality of apertures disposed on an arch length of the base such that the mechanical fastening member is received by the retaining stamping and the base; and forming a compression assembly between the casing, the base, and the retaining insert.

20. The method of claim 19, wherein the projectile comprises a medium caliber projectile.

21. The method of claim 19, wherein the forward end opening includes at least one protrusion on an interior surface to ensure a contact point with the projectile and a predetermined cartridge overall length elevation during assembly.

* * * * *